US008613567B2

(12) United States Patent
Dimillo

(10) Patent No.: US 8,613,567 B2
(45) Date of Patent: Dec. 24, 2013

(54) CLIP AND METHOD FOR JOINING STEEL RIBS USED AS TUNNEL LINER SUPPORTS

(76) Inventor: Tony Dimillo, Newmarket (CA)

( * ) Notice: Subject to any disclaimer, the term of this patent is extended or adjusted under 35 U.S.C. 154(b) by 0 days.

(21) Appl. No.: 12/830,530

(22) Filed: Jul. 6, 2010

(65) Prior Publication Data

US 2012/0009024 A1 Jan. 12, 2012

(51) Int. Cl.
*E21D 11/00* (2006.01)

(52) U.S. Cl.
USPC ..... 405/150.1; 405/279

(58) Field of Classification Search
USPC ..... 405/150.1, 151, 153, 279; 403/397; 284/316.7, 228.7, 229.16, 229.26
See application file for complete search history.

(56) References Cited

U.S. PATENT DOCUMENTS

| | | | | | |
|---|---|---|---|---|---|
| 953,827 | A | * | 4/1910 | Haas et al. | 52/245 |
| 2,388,624 | A | * | 11/1945 | Tashjian | 405/287 |
| 2,971,617 | A | * | 2/1961 | Smith et al. | 52/781 |
| 3,126,708 | A | * | 3/1964 | Jasper | 405/288 |
| 3,318,099 | A | * | 5/1967 | Sugden | 405/153 |
| 3,989,302 | A | * | 11/1976 | Arrington | 299/11 |
| 4,027,488 | A | * | 6/1977 | Preradovich | 405/279 |

FOREIGN PATENT DOCUMENTS

GB 1318398 A * 5/1973

* cited by examiner

*Primary Examiner* — Frederick L Lagman
*Assistant Examiner* — Kyle Armstrong

(57) ABSTRACT

The present invention is directed to a clip connector for joining steel ribs together end to end to provide a support for lateral wood or steel beams used to line a tunnel. The clip connector has a generally C shaped cross section with a web section having a width approximately equal to the width of the flange of the steel rib and a length and shape sufficient to overlap the ends of the joined steel ribs. The clip has flanges extending from either side of the web to wrap around the flange of steel ribs and contain the flange of the steel rib.

2 Claims, 2 Drawing Sheets

CLIP AND METHOD FOR JOINING STEEL RIBS USED AS TUNNEL LINER SUPPORTS

FIELD OF THE INVENTION

The present invention utilizes clips to join vertical rolled I-beams (or other structural shapes) used to support lateral wood or steel beams in a "rib and lagging type" tunnel liner and in particular, clips which provide for a maximum, unobstructed tunnel diameter.

BACKGROUND OF THE INVENTION

In a tunneling operations, a machine removes material from the face of the tunnel and moves the removed material rearwardly to be transported to the surface for disposal. As the tunneling machine excavates the tunnel, it is necessary to provide a liner for the tunnel behind the machine. Presently, liners are either wood/steel beams supported by steel ribs, commonly called "rib and lagging", steel panels or concrete panels. The use of a particular liner system is dependent on ground conditions and cost.

Wood/steel beams supported by ribs have the advantages of lower cost than either steel or concrete panels as well as being easier and faster to install. Presently, the steel ribs are provided in three or more sections which, when connected together end to end, provide either a complete circle for the desired tunnel diameter or the desired shape for tunnel dimensions. The ribs generally are made by rolling an I-beam structure along one flange to form a curved cross section that supports the ends of the wood/steel beams which are installed between two adjacent ribs.

Presently the rib ends are generally connected to one another using plates welded onto the ends of the ribs, typically called butt plates. The butt plates are then connected together by bolts. While such an arrangement provides for a secure connection, it does have certain disadvantages. The installation and tightening of the bolts consumes a significant amount of both material expense and time in the operation of installing the tunnel lining. In addition, the butt plates extend into the interior of the tunnel, thus reducing the effective usable diameter of the tunnel.

There thus remains a need for a less expensive, simpler and quicker way of connecting the steel ribs together.

SUMMARY OF THE INVENTION

The present invention is directed to a tunnel liner of a plurality of curved steel rib sections which are joined together end to end to form a ring encircling the tunnel diameter. The rib sections have an I-shaped cross section with opposing flanges joined by a central web. A plurality of the joined rib sections are provided spaced apart along the length of the tunnel. A plurality of wood or steel lateral beams are provided which connect the joined rib sections, the sides of the lateral beams abutting each other and the ends of the lateral beams being contained within the space between the opposing flanges and butting against the central web to form a complete tunnel liner. The improvement comprises a clip connector for joining the curved steel rib sections together end to end to provide the rib encircling the tunnel to support the lateral beams used to line a tunnel. The clip connector has a generally C shaped cross section with a web section having a width approximately equal to the width of the flange of the steel rib and a length sufficient to overlap the ends of the joined steel ribs. The clip has flanges extending from either side of the web with an inwardly extending edge to wrap around the flange of steel ribs and contain the flange of the steel rib in the space between the inwardly extending edge and the web of the connector.

In an aspect of the invention, there is provided a clip connector for joining steel ribs together end to end to provide a support for lateral wood or steel beams used to line a tunnel. The clip connector has a generally C shaped cross section with a web section having a width approximately equal to the width of the flange of the steel rib and a length sufficient to overlap the ends of the joined steel ribs. The clip has flanges extending from either side of the web with an inwardly extending edge to wrap around the flange of steel ribs and contain the flange of the steel rib.

BRIEF DESCRIPTION OF THE DRAWINGS

Preferred embodiments of the present invention are illustrated in the attached drawings, in which.

DETAILED DESCRIPTION OF THE PREFERRED EMBODIMENTS

Figure 1:
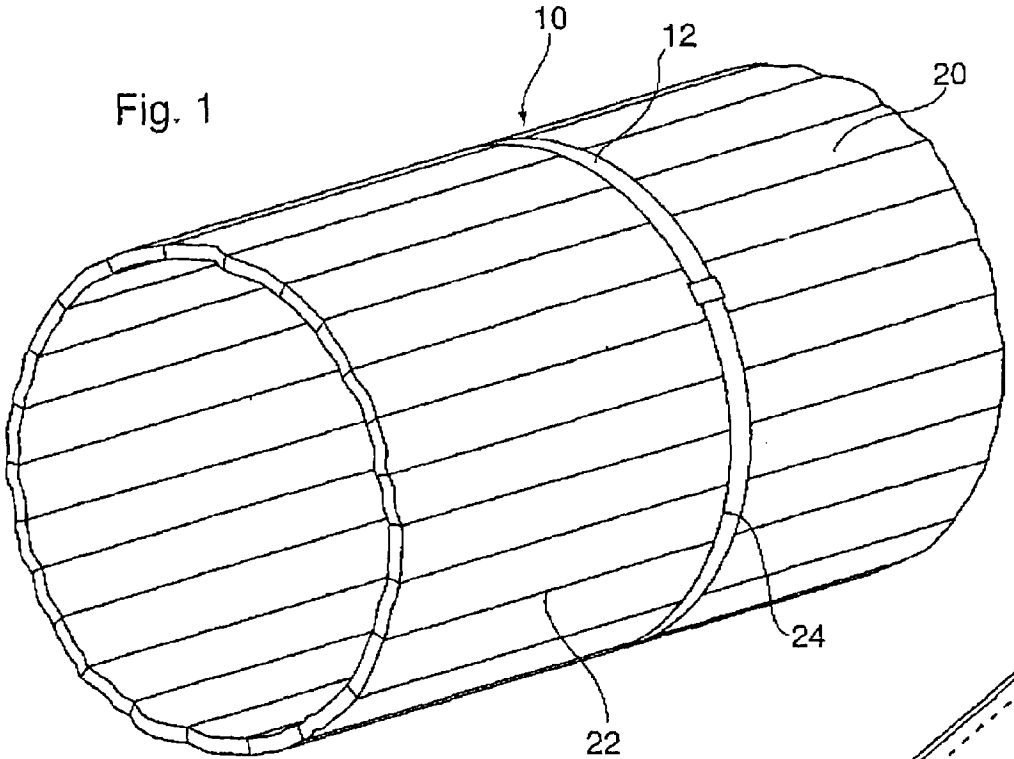
FIG. 1 is a perspective view of a wood beam tunnel lining constructed using the steel ribs and clip connector of the present invention.
Figure 2:
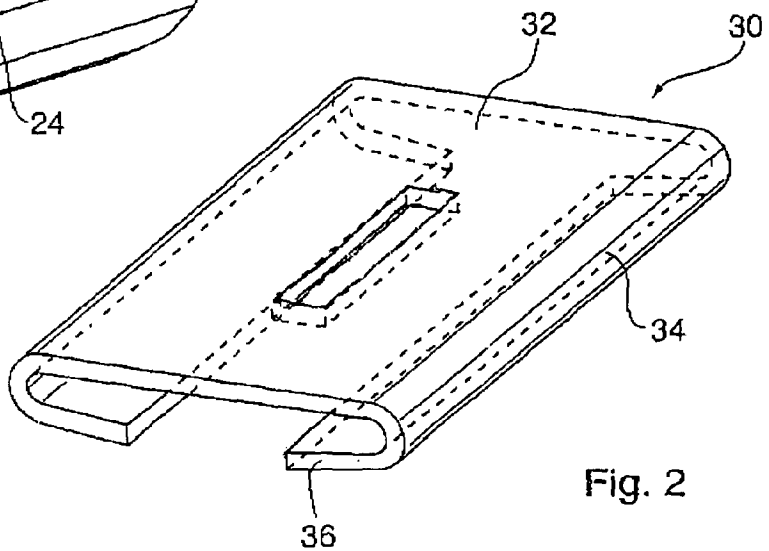
FIG. 2 is a perspective view of a preferred embodiment of the clip connector of the present invention.
Figure 3:
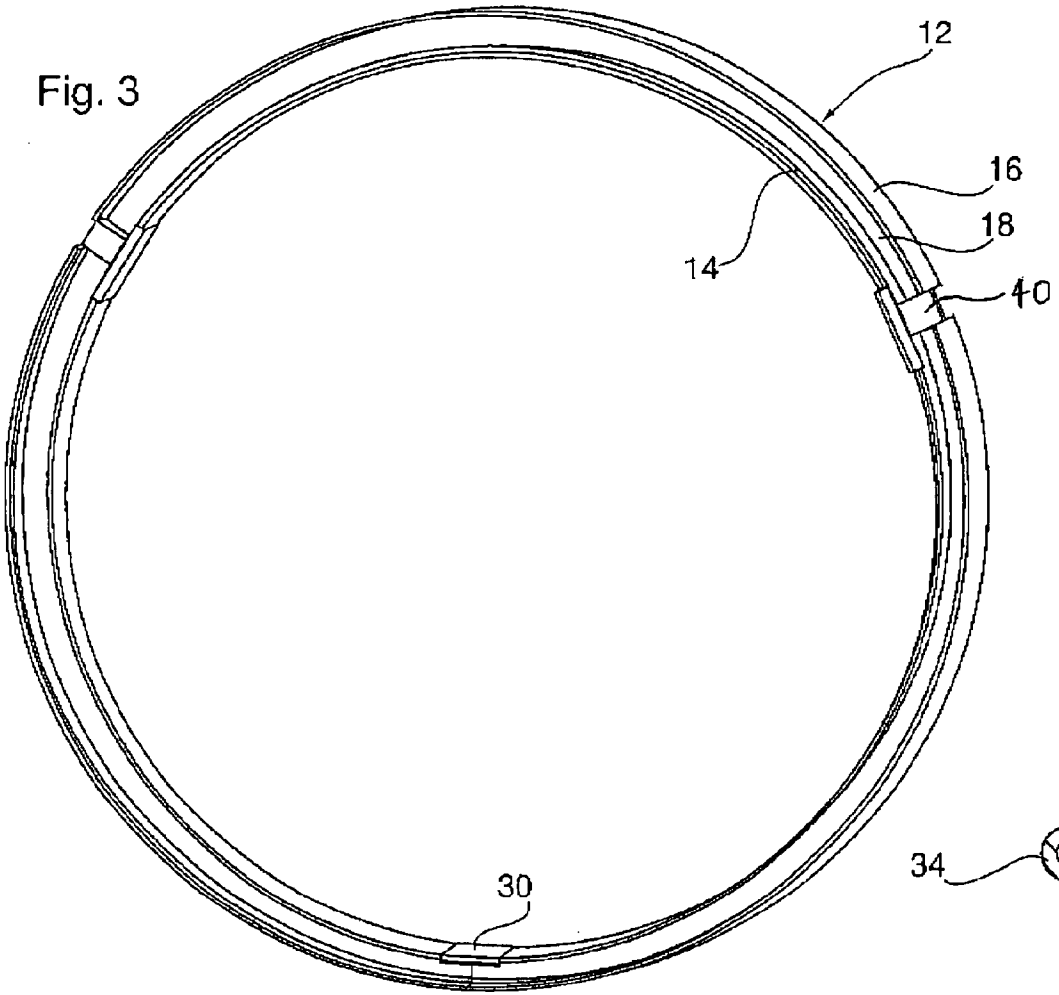
FIG. 3 is a perspective view of the clip connector joining adjacent steel ribs.
Figure 4:
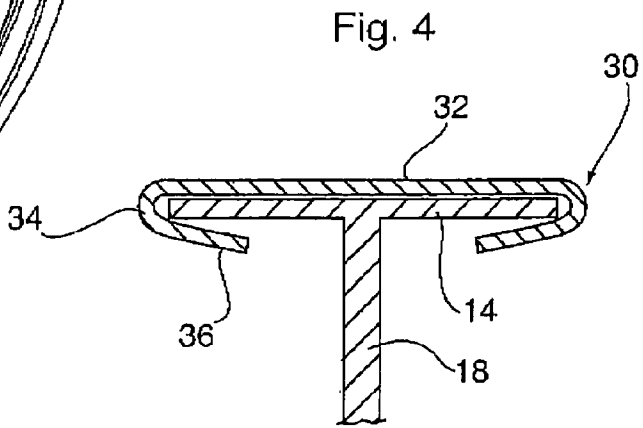
FIG. 4 is a cross section view of the clip connector joining the adjacent steel ribs.

A typical steel rib and lateral beam tunnel lining using the clip of the present invention is illustrated in FIG. 1 generally indicated by the numeral 10. The steel rib and wood beam tunnel lining 10 is comprised of steel ribs 12 which are generally an H or I beam with interior flanges 14 and exterior flanges 16 joined together by a central web 18. The interior flanges 14 will be to the inside of the tunnel lining 10 and the exterior flanges 16 will be adjacent the wall of the tunnel. The spacing between the flanges 14 and 16 of the steel rib 12 is dimensioned to accept the ends of the wood or steel beams 20 as will be described below.

A plurality of steel rib sections 12 are joined together end to end to form a complete circle encircling the interior of the tunnel. Generally, the number of curved rib sections 12 utilized to complete the circle will be selected based upon the tunnel diameter. Most commonly 3 or 4 such curved steel rib sections 12 are utilized for most tunnel diameters, however, those of skill in the art will be able to readily determine the number.

The complete circles of the steel rib sections 12 are spaced apart along the length of the tunnel at a distance approximately equal to the length of the wood or steel lateral beams 20 used in the tunnel lining 10. The lateral beams 20 are installed between the complete circles of the steel rib sections 12 with the sides 22 of the lateral beams 20 abutting each other and the ends 24 of the lateral beams 20 being contained within the space between the opposing interior flanges 14 and exterior flanges 16 and butting against the central web 18 to form the tunnel liner. The process used to install the liner will be described further below.

The ends of the steel rib sections 12 are connected together utilizing a clip connector 30 in accordance with the present invention. A first preferred embodiment of a clip connector 30 in accordance with the present invention is illustrated in the figures. Clip connector 30 is generally C shaped, having a web 32 and flanges 34 extending from either side of the web 32. Flanges 34 have an inwardly extending edge 36, the space between the web 32 and the inwardly extending edge 36 being of a dimension and shape to accept a flange 14 or 16 of the steel rib section 12 as will be described.

A tunnel wall is constructed using the steel ribs 12 and lateral beams 20 as follows. The clip connector 30 is preferably installed on one of the ends of the steel ribs 12. The steel rib sections 12 are then placed against the wall of the tunnel and spaced apart to lie against the tunnel wall. The clip connectors 30 are then slid along the flange 14 or 16 of the steel rib section 12 until they engage the flange 14 or 16 of the adjacent steel rib section 12 and bridge the gap between the steel rib sections 12.

Typically, the steel rib sections 12 will be of a length slightly less than the complete diameter of the final tunnel lining 10. This provides a slight gap between the ends of the installed steel rib sections 12. This gap allows for easier installation of the steel rib sections 12 and it provides a space between the ends of the steel rib sections 12 to allow them to pass one another when being placed against the tunnel wall. The gap between the flanges 14 or 16 of the adjacent steel rib sections 12 is bridged by the length of the clip connector 30 of the present invention. In order to help in maintaining the spacing of the steel rib sections 12, the space between the ends of the webs 18 of the adjacent steel rib sections 12 is filled by a wedge (steel or other material) 40 to hold the steel rib sections 12 in the proper spaced apart relationship.

The lateral beams 20 are then placed in the steel ribs 12 and the next row of steel ribs 12 is installed on the opposite end 24 of the wood beams 20. These steel ribs 12 are installed by placing them over the ends 24 of the wood beams 20 and sliding the clip connectors 30 to engage the adjacent steel rib 12 and lock the steel ribs 12 together.

The clip connector of the present invention provides for an easier and faster way of installing tunnel linings of steel ribs and wood/steel beams. To tie the ends of the steel ribs together requires sliding the clip connector until the adjacent rib is engaged. This is much simpler and faster than having to insert bolts and tighten them down. The clip connectors of the present invention also do not require the attachment of the additional butt plates for the bolts thus also reducing the cost of the steel ribs.

The clip connector of the present invention also allows for tunnels to be constructed with a larger usable diameter than the prior art systems. The clip connector of the present invention lies generally flush against the steel rib of the tunnel lining and does not project into the tunnel as the butt plates of the prior art attachments do.

While the clip connector illustrated in the drawings has a generally C shaped cross section, it will be readily apparent to those of skill in the art that other arrangements for the clip connector may be provided. For example the clip connector could have a generally perpendicular side flange connected to the web at one edge and extending downwardly from the edge of the web and an extension extending inwardly and upwardly from the opposite edge of the flange. In this way, the clip connector could adapt to variations in the thickness of the flange of the rib section or variations in the curvature of the rib section for various tunnel diameters.

The clip connector of the present invention may be used in many types of tunneling operations including utility tunnels, mining operations, etc. The clip connector may also be used in generally vertical as well as generally horizontal shafts. While the clip connector has been described for use in tunneling applications, it will be apparent to those of skill in the art that the clip connector may also have use in other applications where ends of beams are to be connected.

Although various preferred embodiments of the present invention have been described herein in detail, it will be appreciated by those of skill in the art that variations may be made thereto without departing from the spirit of the invention or the scope of the appended claims.

I claim:

1. A tunnel liner comprising a plurality of curved steel rib sections joined together end to end with a gap between at least two of the adjacent rib section ends to form a rib encircling the tunnel diameter or other tunnel shape, the rib sections having an I or H shaped cross section with opposing flanges joined by a central web, a plurality of the joined rib sections being provided spaced apart along the length of a tunnel, a plurality of lateral wood or steel beams being provided which connect the joined rib sections, the sides of the lateral beams abutting each other and the ends of the lateral beams being contained within the space between the opposing flanges and butting against the central web of the steel rib sections to form a complete tunnel liner, a clip connector joining the curved steel rib sections together end to end in a friction fit engagement to provide the rib encircling the tunnel to support the lateral beams used to line a tunnel, the clip connector having a generally C shaped cross section with a web section having a width approximately equal to the width of the flange of the steel rib and a length sufficient to overlap the ends of the joined steel rib sections and bridge the gap between the at least two adjacent rib section ends, the clip connector having flanges extending from either side of the web with an inwardly extending edge to wrap around the flange of the steel rib and contain the flange of the steel rib in the space between the inwardly extending edge and the web of the connector the clip connector being slidable longitudinally along the flange of the rib sections until the clip connector engages both ends of the rib sections where the ends of the joined rib sections abut or are separated by a gap without being fixed thereto.

2. A method of constricting a tunnel liner for lining a tunnel comprising:

a) providing a plurality of curved steel rib sections, having an I or H shaped cross section with opposing flanges joined by a central web, which when joined together end to end define a rib having a diameter substantially the same as the tunnel, at least two of the adjacent rib section ends having a gap therebetween;

b) providing a clip connector having a generally C shaped cross section with a web section having a width approximately equal to the width of the flange of the steel rib and a length sufficient to overlap the ends of the joined steel rib sections and bridge the gap between the at least two adjacent rib section ends, the clip connector having flanges extending from either side of the web with an inwardly extending edge to wrap around the flange of the steel rib and contain the flange of the steel rib in the space between the inwardly extending and the web of the connector where the ends of the joined rib sections abut or are separated by a gap without being fixed thereto by the use of fastening elements;

c) sliding a clip connector onto a flange at an end of one of two rib sections to be joined and then sliding the clip connector longitudinally partially onto the flange at an opposing end of the second of two rib sections to join the ends of the two rib sections together and bridge a gap therebetween without being fixed thereto;

d) repeating the joining of the ends of the rib sections until all of the rib sections are joined together to complete the circle having a diameter substantially the same as the tunnel;

e) placing wedges within the gap between the at least two rib section ends to enlarge the diameter of the rib to that of the diameter of the tunnel;

f) placing a plurality of wood or steel beams perpendicular to the rib sections to line the wall of the tunnel, the beams abutting one another with one end of the each beam lying against the central web of the rib section and being captured within the space between the opposing flanges;

g) repeating steps a) to e) to provide for the rib sections at the other end of the wood beam; and h) continuing to repeat steps f) and g) until the lining of the tunnel is complete.

* * * * *